United States Patent [19]

Ichisaka et al.

[11] 4,317,709

[45] Mar. 2, 1982

[54] APPARATUS FOR ELECTROLYZING AN AQUEOUS SOLUTION

[75] Inventors: Teruo Ichisaka, Tamano; Yoshitugu Shinomiya, Tokyo, both of Japan

[73] Assignee: Chlorine Engineers Corp., Ltd., Tokyo, Japan

[21] Appl. No.: 163,137

[22] Filed: Jun. 26, 1980

[30] Foreign Application Priority Data

Jun. 26, 1979 [JP] Japan ..... 54-79731

[51] Int. Cl.[3] ..... C25B 9/00; C25B 15/08

[52] U.S. Cl. ..... 204/268; 204/270; 204/274

[58] Field of Search ..... 204/254–256, 204/268–270, 274, 95

[56] References Cited

U.S. PATENT DOCUMENTS

| | | | |
|---|---|---|---|
| 1,790,248 | 1/1931 | Roth | 204/268 X |
| 3,849,281 | 11/1974 | Bennett et al. | 204/95 X |
| 3,928,165 | 12/1975 | Piester | 204/270 X |
| 4,139,449 | 2/1979 | Goto et al. | 204/270 |
| 4,151,052 | 4/1979 | Goto et al. | 204/95 |

FOREIGN PATENT DOCUMENTS

| | | | |
|---|---|---|---|
| 933488 | 9/1973 | Canada | 204/268 |
| WO79/00323 | 6/1979 | PCT Int'l Appl. | 204/275 |

*Primary Examiner*—Delbert E. Gantz
*Assistant Examiner*—Donald R. Valentine
*Attorney, Agent, or Firm*—Sughrue, Mion, Zinn, Macpeak & Seas

[57] ABSTRACT

In an apparatus for electrolyzing an aqueous solution, which includes a plurality of electrolytic cells disposed at a plurality of vertically spaced levels and divided by partitions from one another, each of said cells having at least one anode and at least one cathode, said cells including an uppermost cell having an inlet for said solution, and a lowermost cell having an outlet for said solution, the improvement wherein:

(a) each cell being separated into at least two horizontally adjacent cell units;

(b) the separation adapted to direct the solution flow from the top of one unit into the bottom of the adjacent unit enabling solution flow successively through each unit;

(c) a last unit of each cell provided with a passage extending from the top of the last unit to the bottom of the unit at a lower level to direct solution flow downwardly;

(d) the anode and cathode being vertical in each unit opposite each other forming a bipolar electrode assembly; and (e) each unit with a gas collecting zone above the anode and cathode and with a gas riser extending from a partition defining the bottom of each unit to the collecting zone with another end of the gas riser extending through the partition and opening to the collecting zone, and the upper most cell having a gas outlet.

6 Claims, 2 Drawing Figures

APPARATUS FOR ELECTROLYZING AN AQUEOUS SOLUTION

BACKGROUND OF THE INVENTION

1. Field of the Invention

This invention relates to an apparatus for electrolyzing an aqueous solution, particularly of an alkali metal halide. The apparatus is suitable for producing hypohalite (e.g., hypochlorite, hypoiodite or hypobromite), halate (e.g., chlorate, iodate or bromate), perhalate (e.g., perchlorate or periodate), iodine, bromine, and the like.

2. Description of the Prior Art

Generally, an alkali metal hypochlorite is obtained by electrolyzing the alkali metal chloride in a non-diaphragm electrolytic cell, whereby the chlorine formed at the anode is reacted with the alkali formed at the cathode. An alkali metal chlorate is also formed by the reaction between hypochlorous acid and hypochlorite, and can, therefore, be produced by electrolyzing the alkali metal chloride under the conditions which promote the aforementioned reaction. Iodine, hypoiodite, iodate and periodate may be produced by electrolyzing sodium iodide, bromine, hypobromite and bromate by electrolyzing sodium bromide.

The non-diaphragm electrolysis of halides cells for an apparatus which is easy to operate for decomposing the halide effectively and economically with a high current efficiency without occupying a large floor space is desired.

Electrolytic apparatus are known comprising a plurality of vertically aligned electrolytic cells divided by partitions, with each cell provided with an anode and a cathode, as disclosed, for example, in Japanese Patent Publication No. 28104/1977 (corresponding to U.S. Pat. No. 3,849,281), and Japanese Patent Application (OPI) Nos. 31873/1972 and 100998/1978 (corresponding to U.S. Pat. No. 4,139,449).

SUMMARY OF THE INVENTION

It is an object of this invention to provide an improved electrolytic apparatus for producing hypohalite (e.g., hypochlorite, hypoiodite or hypobromite), halate (e.g., chlorate, iodate or bromate), perhalate (e.g., perchlorate or periodate), iodine, bromine, or the like by selecting the electrolytic solution and conditions appropriately.

According to this invention, there is, thus, provided in an apparatus for electrolyzing an aqueous solution, which includes a plurality of electrolytic cells disposed at a plurality of vertically spaced levels and divided by partitions, each of the cells having at least one anode and at least one cathode, the uppermost cell having an inlet for the electrolytic solution, and the lowermost cell having an outlet for the electrolytic solution, the improvement wherein:

(a) each of the electrolytic cells is separated by at least one dividing wall structure into at least two horizontally adjacent cell units;

(b) the dividing wall structure is so designed as to direct the flow of the electrolytic solution from the top of one of the cell units into the bottom of adjacent cell unit, thereby enabling the electrolytic solution to flow successively through each cell unit;

(c) a last cell unit of such cell is provided with an opening extending from the top of the last cell unit to the bottom of a cell unit at a lower level immediately below the aforementioned last cell unit to direct the flow of the electrolytic solution from the last cell unit downwardly into the cell unit at the lower level;

(d) the anode and the cathode are vertically disposed in each cell unit opposite to each other, and form a bipolar electrode extending between the adjacent cell units; and (e) each cell unit has a gas collecting zone defined above the anode and the cathode, and is provided with a gas riser extending from one of the partitions defining the bottom of the cell unit to the gas collecting zone, and opening toward the gas collecting zone in the cell unit at an immediately lower level, the uppermost cell being provided at its top with a gas outlet.

The apparatus of this invention can decompose the electrolyte with an improved efficiency without occupying a large floor space, since the electrolytic cell at each level is divided into a plurality of cell units. Each cell unit, in which at least one anode and at least one cathode are disposed vertically, is so designed as to receive the electrolytic solution at its bottom and release it at its top. This construction permits the gases generated on the cathode to be quickly gathered into the gas collecting zone away from the electrodes, and directed into the gas outlet through the gas risers without contacting the reaction zones on the electrodes. It is, therefore, possible to maintain a low electrolytic voltage in each cell unit. For example, when the apparatus is used for producing hypochlorites or chlorates, it is possible to decrease the amount of $ClO^-$ being returned to the cathode by the convection of the gases, thereby preventing any cathodic reduction by $ClO^-$, and maintaining a high current efficiency.

DETAILED DESCRIPTION OF THE INVENTION

Figure 1:
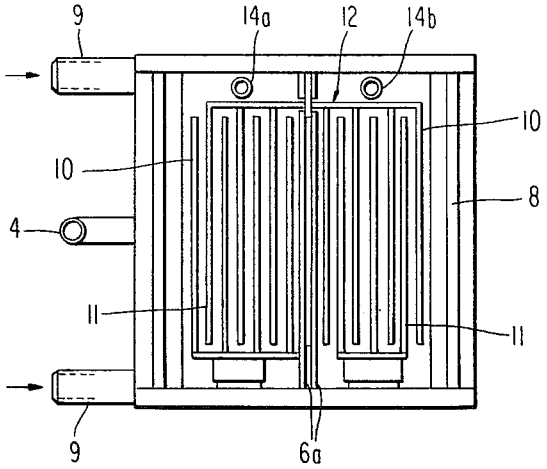
FIG. 1 is a horizontal sectional view of the electrolytic apparatus embodying this invention for producing sodium hypochlorite by electrolyzing sodium chloride.

Referring to the drawings more particularly, the apparatus shown therein comprises a plurality of electrolytic cells 1*a* to 1*e* divided from one another by partitions 2*b* to 2*f*, and disposed at different levels of height vertically adjacent to one another, and includes a top wall 2*a* and a bottom wall 2*g*. The apparatus includes a cooling system 3 to cool an electrolytic solution in order to inhibit the reaction forming a chlorate in the event a hypochlorite is to be produced. The uppermost electrolytic cell 1*a* is provided with an inlet 4 for the electrolytic solution, while the lowermost cell 1*e* has an outlet 5 therefor. Each of the electrolytic cells 1*a* to 1*e* is separated by a dividing wall structure 6*a*, 6*b*, 6*c*, 6*d* or 6*e* into a pair of cell units 7*a* and 7*b*, 7*c* and 7*d*, 7*e* and 7*f*, 7*g* and 7*h*, or 7*i* and 7*j*. The electrolytic solution containing sodium chloride is introduced through the inlet 4 into the bottom of one cell unit 7*a* in the uppermost cell 1*a*. Each of the dividing wall structures 6*a* to 6*e* comprises a pair of planar wall members facing the two cell units in the corresponding cell. The wall member of the dividing wall structure 6*a* facing the cell unit 7*a* in the uppermost cell 1*a* is provided at its top with an opening defining a passage for the electrolytic solution, while the other member thereof is provided with a similar opening at its bottom, so that the electrolytic solution entering the apparatus is directed by the dividing wall structure 6a from the top of the cell unit 7a into the bottom of the cell unit 7b to thereby flow successively through the cell units 7a and 7b. The cell unit 7b is provided at its top with an opening 8 defining a passage through which the electrolytic solution is directed downwardly from the top of the cell unit 7b into the bottom of one cell unit 7c immediately below the cell unit 7b. The electrolytic solution entering the cell unit 7c is directed from the top thereof into the bottom of the adjacent cell unit 7d by the dividing wall structure 6b having its top and bottom openings positioned in staggered relation to those in the dividing wall structure 6a in the uppermost cell 1a. Likewise, the dividing wall structures 6b to 6c, as well as the inlet bottom openings and outlet top openings of the electrolytic cells 1b to 1c, are in staggered relation to one another. The electrolytic solution which have flowed through the cell units 7e and 7f in the electrolytic cell 1c passes through the cooling system 3, and is cooled therein before flowing into the electrolytic cell 1d therebelow. The cooling system 3 includes a cooling tube 9 through which cooling water flows. The electrolytic solution entering the cooling system 3 is cooled by heat exchange as it flows around the cooling tube 9. The solution then passes through the cell units 7g and 7h in the electrolytic cell 1d immediately below the cooling system 3, and the cell units 7i and 7j in the lowermost cell 1e. The solution is, then, discharged through the outlet 5 provided on the last cell unit 7j.

An anode 10 and cathode 11 both in the form of a plate are vertically disposed in mutually opposite relation in each cell unit, and form a bipolar electrode 12 extending between each pair of cell units 7a and 7b, 7c and 7d, or the like. All the cell units are provided with anodes and cathodes, though none is shown in the cell units 7c to 7j in FIG. 2.

Each cell unit has a gas collection zone 13a to 3j defined above the anode and the cathode therein. Each of the electrolytic cells 1a to 1d includes a gas riser 14a to 14h provided in each cell unit, and extending from one of the partitions 2b, 2c, 2d and 2f defining the bottom of the cell to one of the gas collecting zones 13a to 13h in the cell unit. Each gas riser has an upper end which opens to the gas collecting zone in one cell unit, and a lower end formed in the partition, and opening toward the gas collecting zone in another cell unit immediately below the cell in which the upper end of the gas riser is situated. The top wall 2a for the uppermost cell 1a is provided with a gas outlet 15. The gases generated in the cell units 7j and 7i in the lower most cell 1e gather in the gas collecting zones 13j and 13i therein, and directed into the gas collecting zones 13g and 13h in the cell units 7g and 7h, respectively, through the gas risers 14g and 14h. Those gases are mixed with the gases generated in the cell units 7g and 7h, and rise through gas risers 16 in the cooling system 3 into the gas risers 14e and 14f, after which the gases are mixed in the gas collecting zones 13e and 13f with the gases generated in the cell units 7e and 7f, respectively. Likewise, the gases generated in the cell units continue to rise through the multi-storied electrolytic cells without interfering with the electrolytic reaction zones, and are discharged through the gas outlet 15 from the uppermost cell 1a.

The cooling system can be eliminated if the apparatus is used for electrolyzing sodium chloride to produce sodium chlorate, so that the electrolytic solution may be maintained at a temperature of at least 50° C.

The apparatus of this invention may also be used for producing iodine, hypoiodite, iodate, periodate, bromine, hypobromite or bromate by electrolyzing an aqueous solution containing sodium iodide or bromide in suitable electrolytic conditions respectively, as the case may be.

The invention will now be described with reference to an example.

EXAMPLE

Figure 2:
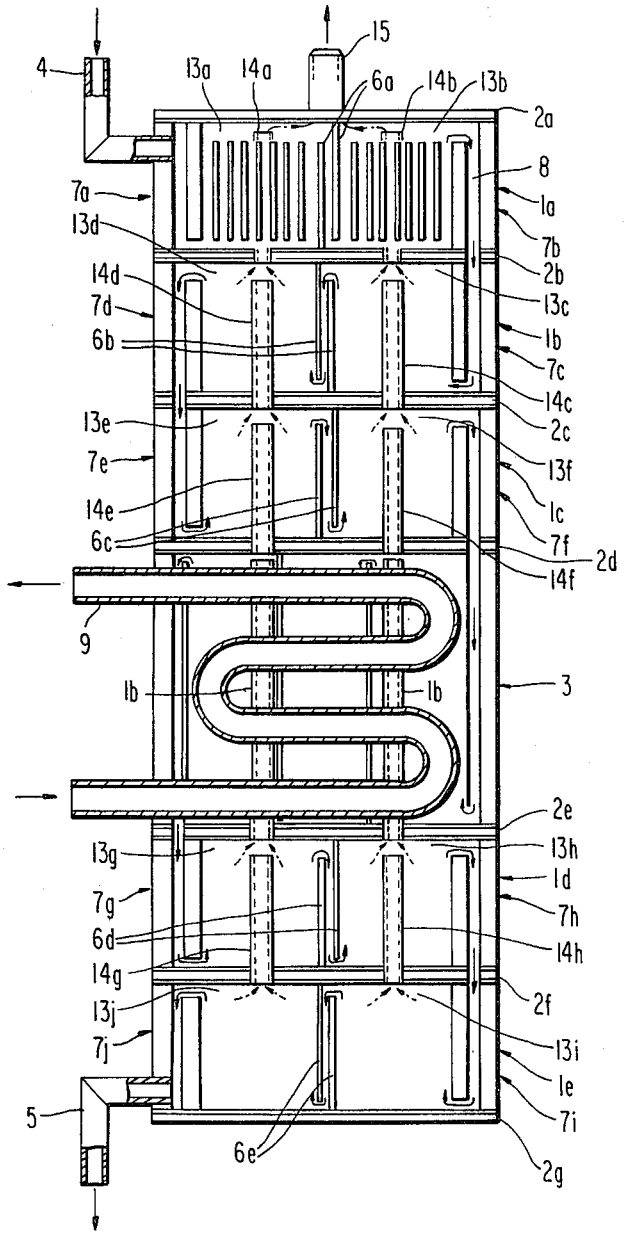
FIG. 2 is a vertical sectional view of the apparatus shown in FIG. 1.

An aqueous solution of sodium chloride was electrolyzed for producing sodium hypochlorite by the apparatus as shown in FIGS. 1 and 2. The conditions of the electrolysis were as follows:

Anodes: Each anode, measuring 200 mm by 80 mm was composed of titanium coated with an oxide of a metal of the platinum group;

Cathodes: Each titanium cathode measured 200 mm by 80 mm;

Distance between the anode and the cathode: 3 mm;

Current density: 15 A/dm$^2$;

Temperature of the electrolytic solution: 39° C.;

Cooling water temperature: 15° C.;

Concentration of sodium chloride in the aqueous solution: 30 g per liter.

As the result, sodium hypochlorite having an effective chlorine concentration of 7,580 ppm was obtained with a current efficiency of 75% and a voltage of 4 V.

While the invention has been described with reference to a preferred embodiment thereof, it is to be understood that variations or modifications may be easily made by anybody of ordinary skill in the art without departing from the scope and spirit of this invention as defined by the appended claims. For example, it is possible to select appropriately the number of the levels at which the electrolytic cells are provided, the number of the cell units forming each electrolytic cell, and the dimensions and numbers of the electrodes provided in each cell unit. It is also possible to use anodes and cathodes in the form of a mesh, perforated plate, or rod, instead of ones in the form of a planar plate.

What is claimed is:

1. In an apparatus for electrolyzing an aqueous solution, which includes a plurality of electrolytic cells disposed at a plurality of vertically spaced levels and divided by partitions from one another, each of said cells having at least one anode and at least one cathode, said cells including an uppermost cell having an inlet for said solution, and a lowermost cell having an outlet for said solution, the improvement wherein:

(a) each of said cells is separated by at least one dividing wall structure into at least two horizontally adjacent cell units;

(b) said dividing wall structure is adapted to direct the flow of said solution from the top of one of said cell units into the bottom of adjacent cell unit, thereby enabling said solution to flow successively through each cell unit;

(c) a last cell unit of each cell is provided with an opening defining a passage extending from the top of said last cell unit to the bottom of a cell unit at a lower level immediately below said last cell unit to direct the flow of said solution downwardly from said last cell unit into said cell unit at said lower level;

(d) said anode and said cathode are vertically disposed in each said cell unit opposite to each other, and form a bipolar electrode assembly extending between said adjacent cell units; and (e) each said cell unit has a gas collecting zone defined above said anode and said cathode, and is provided with a gas riser extending from one of said partitions defining the bottom of said each cell unit to said gas collecting zone in which said gas riser has one open end, said gas riser having another end extending through said one partition and opening toward the gas collecting zone in the cell unit immediately below said each cell unit, said uppermost cell being provided at its top with a gas outlet.

2. An apparatus as set forth in claim 1, wherein said passage extending between one pair of vertically adjacent levels is positioned in horizontally staggered relation to said passage extending between another pair of vertically adjacent levels, thereby positioning an inlet for said solution to one of said cells in staggered relation to an inlet to another cell.

3. An apparatus as set forth in claim 2, wherein said dividing wall structure comprises a pair of vertically disposed wall plates, one of which is formed at its top with an opening defining a passage for said solution, while the other wall plate is provided at its bottom with an opening defining said passage between said wall plates, said openings of said wall plates in one of said cells being positioned in staggered relation to those in the cell adjacent to said one cell.

4. An apparatus as set forth in claim 2 or 3, further including a system for cooling said solution, said cooling system comprising a cooling tube through which cooling water is circulated, said cooling system being situated between two vertically separated cells, and fluidly connected therewith to direct said solution around said cooling tube, said cooling system including a plurality of gas risers aligned with said gas risers in said one cells.

5. An apparatus as set forth in claim 4, wherein said anode and said cathode are in the shape of planar plates.

6. An apparatus as set forth in claim 4, wherein said anode and said cathode are in the shape of rods.

* * * * *